US005458410A

United States Patent [19]

Kun et al.

[11] Patent Number: 5,458,410

[45] Date of Patent: Oct. 17, 1995

[54] ROTATABLE SHELF FOR DRAWER

[76] Inventors: William C. Y. Kun; David C. H. Kun, both of P.O. Box 99733, Tacoma, Wash. 98499

[21] Appl. No.: 196,908

[22] Filed: Feb. 15, 1994

Related U.S. Application Data

[63] Continuation of Ser. No. 779,921, Oct. 21, 1991, abandoned.

[51] Int. Cl.[6] ..... A47B 88/04

[52] U.S. Cl. ..... 312/223.3; 312/208.1

[58] Field of Search ..... 312/26, 208.1, 312/322, 323, 324, 326, 223.3; 248/455; 108/6

[56] References Cited

U.S. PATENT DOCUMENTS

| | | | |
|---|---|---|---|
| 1,219,393 | 3/1917 | Harrison | 248/455 |
| 3,794,397 | 2/1974 | Flototto | 312/194 X |
| 4,428,631 | 1/1984 | Cope et al. | 312/194 |

*Primary Examiner*—Peter R. Brown

[57] ABSTRACT

A rotatable shelf capable of being positioned within a drawer is disclosed. The rotatable shelf can be secured at an angle allowing for the closing of the drawer.

1 Claim, 3 Drawing Sheets

ROTATABLE SHELF FOR DRAWER

This is a continuation of application Ser. No. 07/779,921 filed on Oct. 21, 1991, now abandoned.

SUMMARY OF THE INVENTION

In order to provide for the shutting of a drawer, the keyboard or other electronic device is tipped at an approximate 45 degree angle. At this angle, the keyboard's width is sufficiently diminished to allow for the closing of the drawer.

Two rotatable rods are run lengthwise from the front to the rear of the drawer. A shelf is secured to one of the rods. rotatable support wall is affixed to the other rod.

Thus, when the support wall is angled into position, the shelf and sopported keyboard, etc., are angled to allow for the closing of the drawer.

DETAILED DESCRIPTION OF THE DRAWINGS

Figure 1:
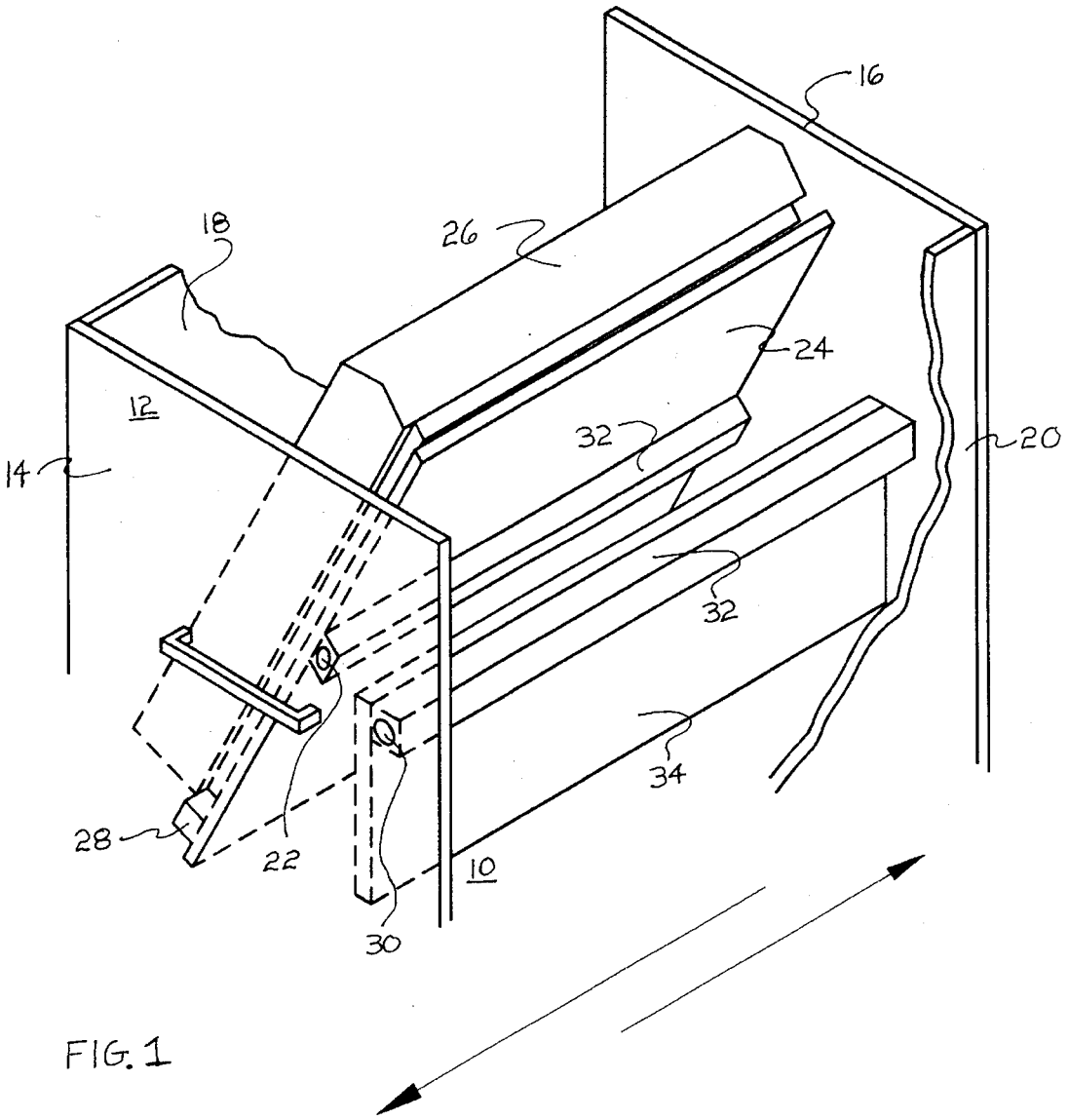
FIG. 1 is a perspective view of the rotatable drawer shelf being lowered into its in-use position.
Figure 2:
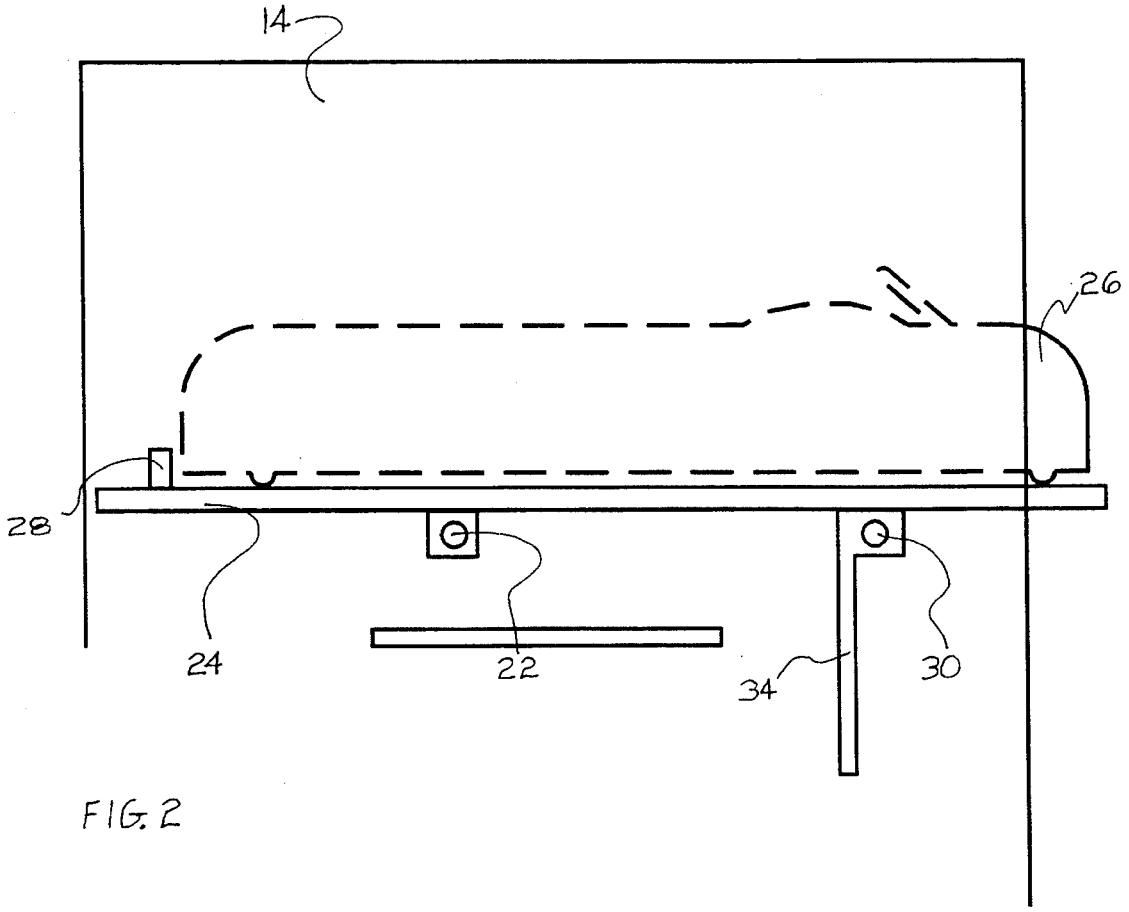
FIG. 2 is a side view, looking from the front wall of the drawer to the back wall, of the rotatable drawer shelf in its inuse, horizontal position.
Figure 3:
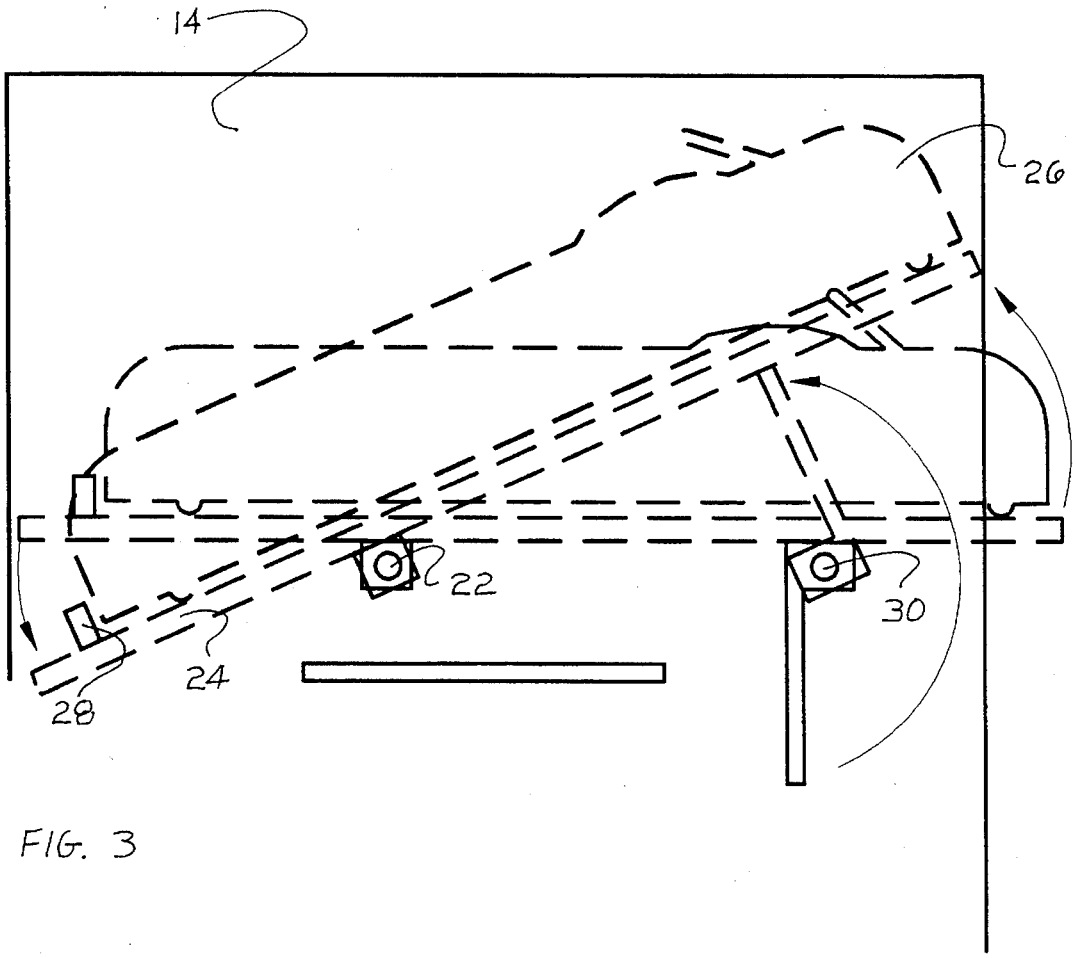
FIG. 3 is a side view of the rotatable drawer shelf in its rotated position ready for the drawer to be inserted. This side view is also viewing from the front wall of the drawer to the back wall.

The rotatable drawer shelf 10 is illustrated in FIG. 1 positioned within drawer 12. The width of the drawer 12 is sufficient to close with the rotatable drawer shelf in the rotated position.

The rotatable drawer shelf 10 fits within a standard drawer 12. As set forth in FIG. 1, the drawer includes a front wall 14, back wall 16, and side walls 18 and 20. A rod 22 is secured between the front wall 14 and back wall 16. The rod 22 is rotatable and provides the support for shelf 24.

The shelf 24 supports and secures a keyboard 26 or similar type of device for the use of the operator. In the illustrated embodiment, shelf guard rail 28 provides a stop for the keyboard 26.

A second rotatable rod 30 is also secured from the front drawer wall 14 to the back drawer wall 16. The second rotatable rod 30 is secured at a position such that if the shelf 24 is allowed to lie on top of both rods 22 and 30, it will lie horizontal.

Both the first rotatable rod 22 and the second rotatable rod have rectangular shells 32 which provide level supports for shelf 24.

Attached to the second rotatable rod 30 is support wall 34. The support wall 34 is capable of rotating a position that holds the shelf 24 at an angle. The support wall 34 forms a straight line whose length is roughly the length of the drawer. The height of the support wall 34 is determined by the angle that the user wishes to define when the support wall is rotated to hold the shelf.

The purpose for the rotatable shelf 24 is to angle the keyboard or secured device to allow the drawer to be shut. Thus, when the user wishes to use the keyboard, the drawer is opened. After opening, the support wall 34 is rotated free thereby allowing the shelf to rotate to a horizontal position that rests on both the rotatable rods 22 and 30.

When the user is finished, the shelf 24 is lifted until the support wall 34 is engaged against the shelf. After the support wall 34 is engaged, the user merely closes the drawer.

In the preferred embodiment the height of the drawer front, back and sides are greater than the height of the angled shelf 24 plus device. The height of the drawer faces are aesthetic, allowing the shelf plus device to be hidden. However, it is necessary that the opening for the drawer is sufficient in height to allow for the insertion of the angled shelf plus secured device.

I claim:

1. A rotatable drawer shelf positioned within a drawer wherein the shelf provides support for a device such as a typewriter, wherein when the shelf is at an angled position the shelf and device can be stowed comprising:

a drawer;

a front drawer wall;

a back drawer wall;

a first rotatable rod positioned between the front drawer wall and back drawer wall;

a support wall attached to the first rotatable rod wherein the heighth of the support wall is such that it is less than the distance defined between the first rotatable rod and the imaginary plane defined by the lower edges of the front drawer wall and the back drawer wall and further, Wherein the support wall is able to rotate approximately 180 degrees;

a means for rotatably securing the first rotatable rod between the front drawer wall and back drawer wall;

a second rotatable rod positioned between the front drawer wall and back drawer wall wherein the second rotatable rod is at approximately the same vertical heighth as the first rotatable rod and further, where the second rotatable rod is positioned at a horizontal distance from the first rotatable rod greater than the heighth of the support wall;

said means for rotatably securing the second rotatable rod such that when the shelf is in a horizontal use position, the shelf rests upon the first rotatable rod for support, and the support wall extends downwardly; wherein when the shelf is at the angled stowed position, the support wall is rotated to extend upwardly where it abuttingly supports said shelf in its stowed position a means for securing the support wall to the shelf when anqled, sufficient to prevent the further rotation of the shelf towards a horizontal position.

* * * * *